US008549713B2

(12) United States Patent
Anzini et al.

(10) Patent No.: US 8,549,713 B2
(45) Date of Patent: Oct. 8, 2013

(54) ZIPPERED SECURITY BAG

(75) Inventors: David J. Anzini, Middletown, NY (US); Eric Plourde, Frankfort, IL (US); Robert C. Stolmeier, Shelbyville, IN (US); Lawrence Share, Skokie, IL (US); Owen J. McGarel, Naperville, IL (US); Tilak R. Varma, Grayslake, IL (US); Kevin P. Olechowski, Bourbonnais, IL (US); Paul Michael Jenkins, Hendersonville, TN (US); Kenny E. McCracken, Dacula, GA (US)

(73) Assignee: Illinois Tool Works Inc., Glenview, IL (US)

( * ) Notice: Subject to any disclaimer, the term of this patent is extended or adjusted under 35 U.S.C. 154(b) by 262 days.

(21) Appl. No.: 12/951,664

(22) Filed: Nov. 22, 2010

(65) Prior Publication Data

US 2011/0283488 A1 Nov. 24, 2011

Related U.S. Application Data

(60) Provisional application No. 61/296,529, filed on Jan. 20, 2010.

(51) Int. Cl.
*B65D 33/16* (2006.01)

(52) U.S. Cl.
USPC ..... 24/399; 24/30.5 R; 24/304; 24/405; 24/585.12; 383/63

(58) Field of Classification Search
USPC ..... 383/63, 61.2, 64; 24/382, 384, 399, 24/400, 405, 585.1, 585.11, 585.12, 24/30.5 R, 304, 389, 704.1, DIG. 39, 24/DIG. 50
See application file for complete search history.

(56) References Cited

U.S. PATENT DOCUMENTS

| | | | | |
|---|---|---|---|---|
| 4,410,130 | A * | 10/1983 | Herrington | 383/62 |
| 4,832,505 | A | 5/1989 | Ausnit et al. | |
| 5,040,903 | A * | 8/1991 | Schramer | 383/70 |
| 5,366,294 | A * | 11/1994 | Wirth et al. | 383/210.1 |

(Continued)

FOREIGN PATENT DOCUMENTS

| | | |
|---|---|---|
| EP | 0 657 363 | 6/1995 |
| EP | 1 739 024 | 1/2007 |

(Continued)

OTHER PUBLICATIONS

International Search Report, PCT Application No. PCT/US11/020734; Jul. 20, 2011.

*Primary Examiner* — Robert J Sandy
*Assistant Examiner* — Louis Mercado
(74) *Attorney, Agent, or Firm* — McCarter & English, LLP

(57) ABSTRACT

A security zipper is provided, which includes a consumer side zipper pair and a product side zipper pair, where each zipper pair is capable of secure mating. Between the zipper pairs is an intermediate flange pair which is layered with an adhesive as well as an adhesive enhancer to securely connect the intermediate flange pair. A slider is provided over the consumer side zipper pair, the product side zipper pair and the intermediate flange pair which mates the zipper pairs and connects the intermediate flanges so that the zipper is securely closed. A bag is also disclosed, which includes the security zipper and a connected product side pouch. In addition, a method for manufacturing the bag is disclosed.

17 Claims, 7 Drawing Sheets

(56) References Cited

U.S. PATENT DOCUMENTS

| | | | | |
|---|---|---|---|---|
| 5,425,825 | A * | 6/1995 | Rasko et al. | 156/66 |
| 5,435,864 | A * | 7/1995 | Machacek et al. | 156/66 |
| 5,662,420 | A * | 9/1997 | Sinda et al. | 383/205 |
| 5,749,658 | A * | 5/1998 | Kettner | 383/204 |
| 6,004,032 | A * | 12/1999 | Kapperman et al. | 383/5 |
| 6,286,999 | B1 * | 9/2001 | Cappel et al. | 383/5 |
| 6,582,122 | B2 * | 6/2003 | Shimizu | 383/63 |
| 6,691,383 | B2 * | 2/2004 | Linton | 24/585.12 |
| 7,004,631 | B1 * | 2/2006 | Egashira et al. | 383/64 |
| 7,036,988 | B2 * | 5/2006 | Olechowski | 383/210.1 |
| 7,090,397 | B2 * | 8/2006 | Stolmeier | 383/64 |
| 7,134,192 | B1 * | 11/2006 | Savicki et al. | 29/766 |
| 7,137,736 | B2 * | 11/2006 | Pawloski et al. | 383/61.2 |
| 7,410,298 | B2 * | 8/2008 | Pawloski | 383/61.2 |
| 7,415,810 | B2 * | 8/2008 | Plourde et al. | 53/412 |
| 7,437,805 | B2 * | 10/2008 | Berich | 24/399 |
| 7,490,989 | B2 * | 2/2009 | Kobetsky et al. | 383/64 |
| 7,553,082 | B2 * | 6/2009 | Yoder | 383/64 |
| 7,674,039 | B2 * | 3/2010 | McMahon et al. | 383/61.2 |
| 8,202,002 | B2 * | 6/2012 | McMahon et al. | 383/61.2 |
| 2004/0047524 | A1 * | 3/2004 | Stolmeier et al. | 383/210 |
| 2004/0161178 | A1 | 8/2004 | Olechowski | |
| 2004/0234170 | A1 * | 11/2004 | Pawloski et al. | 383/61.2 |
| 2005/0008266 | A1 * | 1/2005 | Crunkleton et al. | 383/5 |
| 2006/0029300 | A1 | 2/2006 | Yoder | |

FOREIGN PATENT DOCUMENTS

| | | |
|---|---|---|
| JP | 7 223657 | 8/1995 |
| JP | 2000 072157 | 3/2000 |
| WO | 2004103840 | 12/2004 |

* cited by examiner

ZIPPERED SECURITY BAG

CROSS-REFERENCE TO RELATED APPLICATIONS

This application claims priority to U.S. Provisional Patent Application No. 61/296,529 filed on Jan. 20, 2010 on behalf of David J. Anzini, et al., the disclosure of which is incorporated herein by reference.

BACKGROUND OF THE DISCLOSED EMBODIMENTS

1. Field of the Disclosed Embodiments

The present invention relates to a security zipper, a zippered security bag, and a manufacturing method therefor.

2. Description of the Related Art

There is often a need for a bag, or flexible package, which is designed to be closed one time and that: (1) once closed, reopening causes damage, preferably visual damage, to the package; (2) preferably cannot be reopened through the original package opening; and (3) is sealed to prevent pilferage of the contents. Packages with these features are often referred to as "security bags" and are used to contain valuable or important contents such as money transfers for banks and companies responsible for ATMs (automatic teller machines), for crime evidence, or for medical specimens.

Current packages used for these applications typically have a wide strip of pressure sensitive adhesive (PSA) covered with a release liner on a flap of an envelope type package. The package is typically made from a tough polyolefin base film made from resins including LDPE. LLDPE, PP, HDPE, mLLDPE, or blends, co-extrusions, or laminations of any combination.

The user places one or more items in the package, removes the release liner, folds the flap over the opposite package wall and seals the flap to the outer face of the opposite package wall. This is problematic in that wrinkles are often created in the adhesive seal area, particularly when the items are large or heavy or when a flat surface is not available to rest the package on during sealing. It is also difficult to completely seal the sides of the package where the flap is folded. These deficiencies result in gaps that allow access to the interior of the package, presenting opportunities for pilferage, contamination, or leakage of the contents.

Another deficiency is the reliance solely on the adhesive-to-bag film bond to maintain the closure of the bag. It is well known that PSAs when cooled lose their flexibility and bond strength. When reduced to temperatures well below zero Fahrenheit, the PSAs can lose their adhesive properties and can be easily peeled from one or both of the package surfaces, allowing access to the package contents. Once the adhesive returns to room temperature it regains its adhesive properties and the package can be re-closed, leaving no visual signs of tampering.

SUMMARY OF THE DISCLOSED EMBODIMENTS

A security zipper is provided, which includes a consumer side zipper pair and a product side zipper pair, where each zipper pair is capable of secure mating. Between the zipper pairs is an intermediate flange pair which is layered with a release liner coated adhesive as well as an adhesive enhancer to securely connect the intermediate flange pair. A slider is provided over the consumer side zipper pair, the product side zipper pair and the intermediate flange pair which mates the zipper pairs and connects the flanges so that the zipper is securely closed. A bag is also provided, which includes the security zipper and a connected product side pouch.

A method of manufacturing the disclosed bag is also provided. The method includes feeding an unmated zipper assembly into a bag making process and orienting the zipper elements into a mating position. The method includes mating only certain portions of the zippers, in the area of bag side seals. The method further includes modifying a length of a release liner on the adhesive by removing a portion of the liner so it does not extend into the area of the bag side seals. In addition, the release liner can be folded so that it extends above the top of the zipper in a bag height-wise direction and forms a pull tab.

BRIEF DESCRIPTION OF THE FIGURES

Further objects and advantages of the invention will become apparent from the following description and from the accompanying drawings, wherein.

DETAILED DESCRIPTION OF THE DISCLOSED EMBODIMENTS

Figure 1:
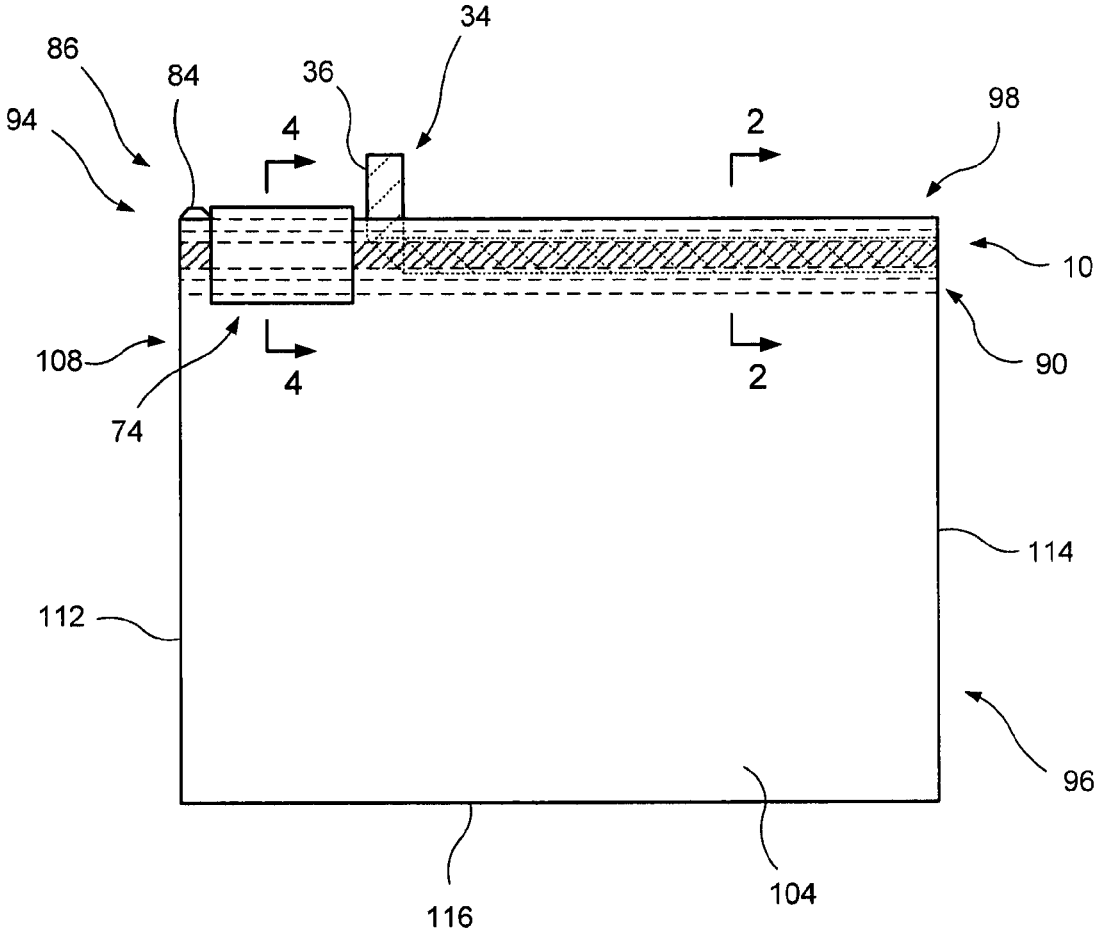
FIG. 1 illustrates a disclosed bag with a disclosed security zipper.
Figure 2:
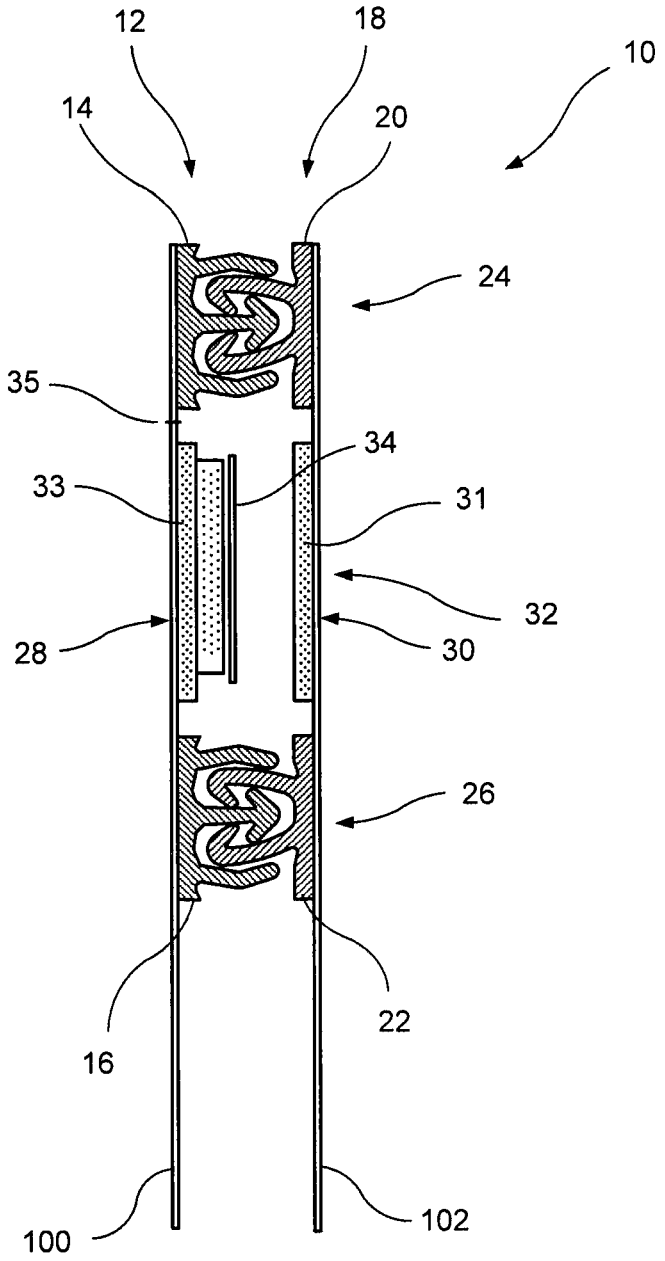
FIG. 2 illustrates a cross sectional view of the disclosed security zipper cut along line 2-2 in FIG. 1.

Turning to FIGS. 1 and 2, a security zipper 10 is illustrated according to an embodiment of the invention. The zipper 10 includes a first profile 12 which includes a first consumer side interlocking element 14 and a first product side interlocking element 16 spaced therefrom by a first intermediate flange 28. A second profile 18 is provided which includes a second consumer side interlocking element 20 and a second product side interlocking element 22 spaced therefrom by a second intermediate flange 30.

The first and second consumer side interlocking elements 14, 20 together define a pair 24 of consumer side interlocking elements and the first and second product side interlocking elements 16, 22 together define a pair 26 of product side interlocking elements. Both pairs of interlocking elements 24, 26 are capable of secure mating. In addition, the first and second intermediate flanges 28, 30 together define a pair of intermediate flanges 32 which are capable of secure connecting. When the pairs of interlocking elements 24, 26 and the pair of intermediate flanges 32 are secured to each other, the profiles 12, 18 are secured to each other, and the zipper 10 is securely closed.

The first intermediate flange 28 includes a PSA having a high bond strength and a high cohesive strength. The second intermediate flange 30 comprises an adhesive enhancer 31, also known as an adhesive receptive coating surface or a receptive surface. Alternatively, both surfaces can be treated with a PSA and an adhesive enhancer, so that enhancer 33 would also be provided.

On the one hand, a PSA with an acceptable strength and adhesion characteristic includes T2 2049 by Collano Adhesives AG, CH-6203 Sempach-Station, Switzerland. On the other hand, the adhesive enhancer is a layer, or coating, that is more compatible with PSAs than typical polyolefins. Materials for the adhesive enhancer can include, but are not limited to, modified ethylene vinyl acetate such as Bynel materials by DuPont or a modified polyolefin such as, but not limited to, maleic anhydride functional groups.

The security zipper 10 includes a release liner 34 which covers the PSA. As can be appreciated, there would be two liners if the PSA was applied to both intermediate flanges 28, 30. The release liner 34 which can be peeled from the PSA and protects the surface from degradation and inadvertent contact with other surfaces. The release liner 34 includes a tab 36 for removing the release liner 34 from the PSA. The tab 36 extends past the consumer side of the zipper 10 for engagement by a user. In addition, a perforation 35 is provided between interlocking elements 14 and 16 which can be utilized for evidence of tampering. That is, if the bag is tampered with, the weakened perforated area 35 will split open.

One or both of the first consumer side interlocking element 14 and the first product side interlocking element 16 is a male zipper element. On the other hand, a corresponding one or both of the second consumer side interlocking element 20 and the second product side interlocking element 22 is a female zipper element. In the illustrations, the interlocking elements 14, 16 on the first profile 12 are male zipper elements and the interlocking elements 20, 22 on the second profile 18 are female zipper elements.

Figure 3B:
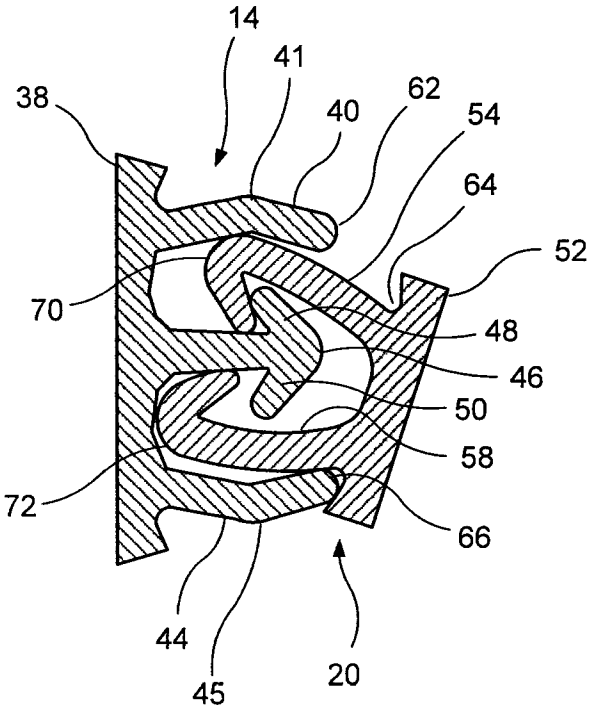
FIGS. 3A-3B illustrate cross sectional views of a zipper pair.
Figure 3A:
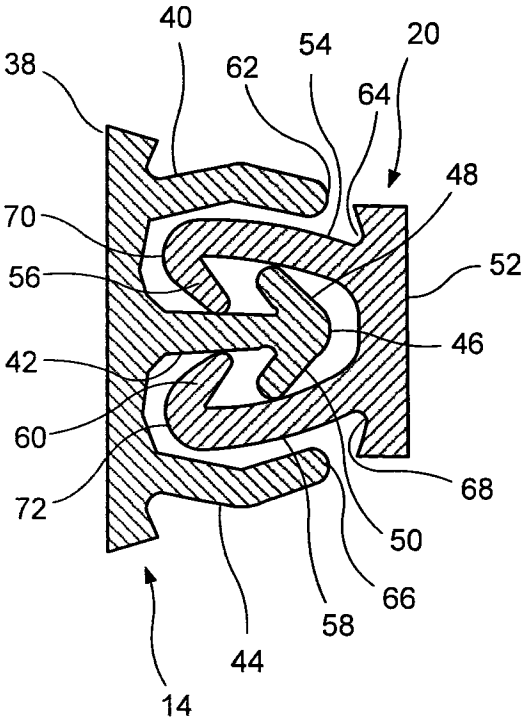

Turning to FIG. 3A, attention is drawn to the consumer side pair of zipper elements 24, though the same discussion applies to the product side pair of zipper elements 26. The male zipper element 14 includes a base 38, a consumer side exterior rib 40, a central rib 42, and a product side exterior rib 44. The central rib 42 has a distal end wedge 46 that has a consumer side hook 48 and a product side hook 50. On the other hand, the female zipper element 20 includes a base 52 and a consumer side leg 54 having a distal end foot 56 and a product side leg 58 having a distal end foot 60. As provided in the illustration, the male zipper element 14 and the female zipper element 20 are substantially symmetric about respective centerlines extending parallel to a bag thickness direction, that is a direction perpendicular to a bag height-wise direction and a bag widthwise direction.

When the zipper elements 14, 20 are mated and not pivoted relative to each other, the legs 54, 58 fit between respective exterior ribs 40, 44 and are spaced from each other by the central rib 42, and the exterior ribs 40, 44 are spaced from respective legs 54, 58. In addition, the consumer side foot 56 contacts the consumer side of the central rib 42 and the product side foot 60 contacts the product side of the central rib 42. Further, the consumer side hook 48 contacts the consumer side leg 54 and the product side hook 50 contacts the product side leg 58.

In addition, in the pair of zipper elements 24, the hooks 48, 50 are oriented toward the male zipper base 38 and the feet 56, 60 are oriented toward the female zipper base 52. Further, the exterior ribs 40, 44 extend away from the male zipper base 38 and away from each other until reaching respective lengthwise midpoints 41, 45, increasing a distance between the exterior ribs 40, 44 in bag height-wise direction. From the midpoints 41, 45, the exterior ribs 40, 44 extend further away from the male zipper base 38 and toward each other until reaching respective distal ends 62, 66 of the ribs, decreasing a distance between the exterior ribs 40, 44 in bag height-wise direction. On the other hand, the legs 54, 58 extend away from the female zipper base 52 and away from each other until reaching respective distal ends 70, 72 of the legs, thereby increasing a distance between the legs 54, 58 in a bag height-wise direction.

Based on the above structure, within the mated pair of zipper elements 24, when the zipper elements 14, 20 are not pivoted relative to each other and are translated away from each other in the bag thickness direction, the consumer side hook 48 engages the consumer side foot 56 and the product side hook 50 engages the product side foot 60.

Referring to FIG. 3B, when the female zipper base 52 is pivoted towards the product side relative to the male zipper element 14, the product side foot 60 engages the product side of the central rib 42 and a distal end 66 of the product side rib 44 engages a product side joint 68 located between the product side leg 58 and the female zipper base 52. At this same time, a distal end 70 of the consumer side leg 54 engages the consumer side rib 40 and the consumer side foot 56 engages both the consumer side of the central rib 42 and the consumer side hook 48.

Furthermore, when the female zipper base 52 is pivoted towards the consumer side relative to the male zipper element 14, the consumer side foot 56 engages the consumer side of the central rib 42 and a distal end 62 of the consumer side rib 40 engages a consumer side joint 64 located between the consumer side leg 54 and the female zipper base 52. At this same time, a distal end 72 of the product side leg 58 engages the product side rib 44 and the product side foot 60 engages both the product side of the central rib 42 and the product side hook 50.

As a result of the above interactions between the male zipper element 14 and female zipper element 20, neither translating nor pivoting of the zipper elements relative to each other will result in separation. Thus, the zipper configuration, when mated, provides a secured and relatively inseparable, substantially permanent connection. While this inseparable, substantially permanent connection does not prevent the forcing open of the zipper, the resultant destruction will provide immediately apparent tamper evidence.

In other words, as illustrated, the male zipper element 14, with its hooked wedge 46, fits into the area between the female zipper base 52 and the legs 54, 58. When attempts are made to reopen the zipper 10 from either side, the noted pivoting creates a wedging action which forces the hooks 48, 50 and feet 56, 60 of the zipper to engage more aggressively, making it harder for someone to open the zipper. Further, the consumer side rib 40 of the male zipper element 14 makes it more difficult for someone to use a tool, such as a small screwdriver or blade, to pry the zipper apart without causing noticeable damage to the zipper and/or bag. To enhance the difficulty of reopening, the zipper elements 14, 20 can be made from materials other than the typical LDPE polyolefin, such as a polypropylene (PP) resin, which is stiffer and maintains its high modulus at a higher temperature than LDPE and at a lower temperature then LDPE.

Figure 4:
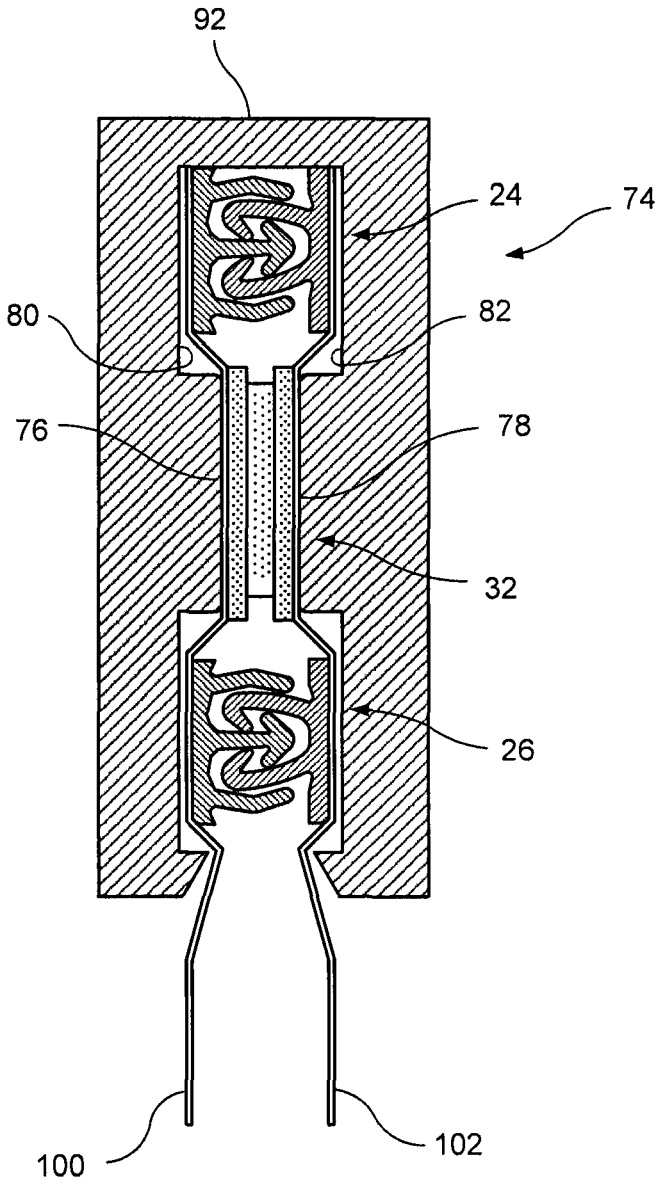
FIG. 4 illustrates the cross sectional view of the security zipper with a slider cut along line 4-4 in FIG. 1.

As illustrated in FIGS. 1 and 4, a slider 74 is provided which surrounds the pair of consumer side interlocking elements 24, the pair of intermediate flanges 32, and the pair of product side interlocking elements 26. With the release liner removed, sliding the slider 74 in a bag widthwise direction across the security zipper 10 securely mates the pair of consumer side interlocking elements 24 and the pair of product side interlocking elements 26, and securely connects the pair of intermediate flanges 32, securely closing the zipper 10.

Further, the slider 74 includes a first pressure bar 76 for biasing the first intermediate flange 28 towards the second intermediate flange 30. The slider also includes a second pressure bar 78 for biasing the second intermediate flange 30 towards the first intermediate flange 28. Accordingly, sliding the slider 74 across the zipper 10 engages the PSA and the adhesion enhancer.

In addition, the slider 74 has a first inner wall 80 which is essentially parallel with the first intermediate flange 28 and a second inner wall 82 which is essentially parallel with the second intermediate flange 30. The first pressure bar 76 can be cantilevered to the first inner wall 80 and the second pressure bar 78 can be cantilevered to the second inner wall 82, though cantilevering is not required. That is, the pressure bars 76, 78 can have a fixed gap between them, or they can be cantilevered in order to keep a relatively constant pressure between them.

As illustrated in FIG. 1, a first endstop 84 is disposed at a first bag widthwise end 86 of the security zipper 10. The endstop 84 prevents the slider 74 from sliding off of the security zipper 10 at the first bag widthwise end 86 of the zipper 10. The endstop 84 is formed from compressing, for example, by crushing the consumer side zipper pair 24 at the widthwise end 86 of the zipper 10.

A second endstop (not illustrated) can be disposed at a second bag widthwise end 90 of the security zipper 10 for preventing the slider 74 from sliding off of the security zipper 10.

As illustrated in FIG. 1, a bag 94 is disclosed which utilizes the zipper 10. The bag 94 includes product pouch 96, a bag mouth 98, and the security zipper 10 disposed in a bag widthwise direction across the bag mouth 98. To connect the pouch 96 with the zipper 10, as illustrated in FIGS. 2 and 4, the first profile 12 includes a first product side flange 100 and the second profile 18 includes a second product side flange 102. On the other hand, the pouch 96 includes a first bag panel 104 and a second bag panel (not illustrated).

A consumer side end 108 of the first bag panel 104 is fixed to the first product side flange 100. In addition, a consumer side end (not illustrated) of the second bag panel is fixed to the second product side flange 102. Moreover, the first bag panel 104 is connected to the second bag panel at a first widthwise side seal 112, a second widthwise side seal 114, and a bottom edge 116 of the pouch 96. As can be appreciated, if the first and second bag panels are formed from a single, folded over web, then the bottom edge 116 would not be formed from a seal.

The user of the bag 94 would place one or more items in the pouch 96, the release liner 34 would be removed, and the slider 74 moved across the top of the package causing the zipper elements 14, 20 to mate and also forcing the PSA to contact the adhesion enhancer on the opposing bag wall. The adhesive and cohesive strength of the PSA is such that any strenuous attempt to peel the surfaces apart would result in visual distortion of the surrounding packaging film. The PSA could also be colored so that any strenuous attempt to peel the PSA apart would create visual indicators of stress in the PSA, alerting someone to the attempt to reopen the bag 94.

Accordingly, the above disclosed embodiments provide a package that once closed, typical implements would be unable to reopen over a broad range of conditions and, rather, the bag would show signs of tamper if there is an effort to reopen. As explained above, a typical PSA closure used for a security bag can be defeated using low temperatures. However, in the disclosed design, attempts to chill the PSA result in the modulus (stiffness) of the polyolefin profile to increase, rendering it even more difficult to open the zipper elements without causing visual damage to the package. The proximity of the PSA to the zipper elements ensures that an attempt to cool the PSA will result in a cooling of the zipper elements.

In addition, heating a standard zipper reduces the modulus of the resin used to form the zipper elements, making it easier to reopen. In the disclosed embodiments, polypropylene can be used, which has a higher modulus than LDPE at higher temperatures. Moreover, the PSAs described above are relatively unaffected by elevated temperatures.

Furthermore, having a second zipper closure on the product side, below the PSA closure, makes it less likely that someone could freeze the PSA and then open the zipper by using a known pinch-grip method. This configuration is superior to the use of a single pair of consumer side zipper elements.

Figure 5:
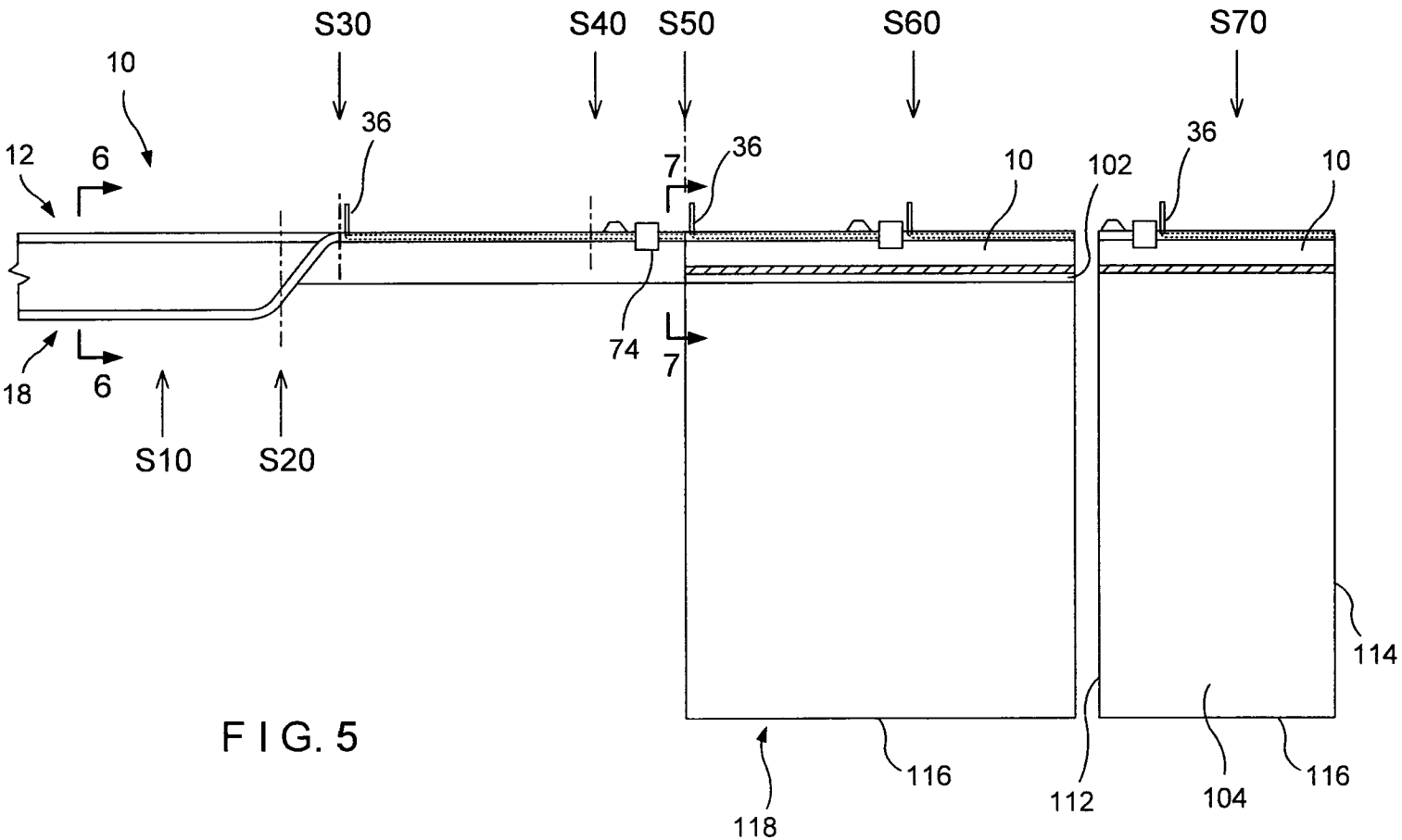
FIG. 5 illustrates a process for manufacturing a bag having the security zipper.

A method of manufacturing the disclosed bag will now be described. As illustrated in FIG. 5, the method includes a step S10 of providing a long length of the security zipper 10, in a prefabricated form, where the prefabricated form is illustrated in a cross sectional view in FIG. 6. The prefabricated security zipper 10 includes the first profile 12 and the second profile 18, where the first profile 12 includes the release liner 34, which is continuous and disposed over the PSA on the first intermediate flange 28. The security zipper 10 is provided so that the span of each profile 12, 18, in a bag widthwise direction, is parallel with the machine feed direction for the bag web, which will also be provided along a bag widthwise direction.

The manufacturing process includes the step S20 of positioning the first profile against the second profile. In this position, the interlocking elements 24, 26 are placed against each other. The manufacturing method also includes a step S30 of modifying the size of the release liner 34 in a bag widthwise direction so that it does not extend to areas where the bag side seals 112, 114 will be subsequently located. With the release liner 34 modified, the manufacturing process includes the step (not illustrated) of mating the consumer side pair of interlocking elements 24 and product side pair of interlocking elements 26 in the areas where the side seals 112, 114 will be subsequently located, while leaving the rest of the zipper elements unmated. In addition, a portion of the release liner 34 can be folded at a ninety degree angle to the zipper 10, leaving a section of zipper 10 without a release liner 34. The section without the release liner 34 will subsequently be the area of the sides of the bag.

At this point, the slider endstop 84 is formed in step S40. In step S50, the slider 74 is fitted over the arranged pairs of interlocking elements 24, 26 and intermediate flanges 32. adjacent to the endstop 84. Thereafter in step S60, a bag web 118, constituting the bag panels, including panel 104, is provided and sealed to the product side flanges 100, 102 of the respective profiles 12, 18. As indicated, the bag web 118 is continuously fed with the bag widthwise direction, parallel with the machine feed direction. Accordingly, the bottom seal 116 (which may be replaced by a fold) is provided in the web 118, but not side seals 112, 114. As illustrated in FIG. 5, the bag web 118, with the zipper 10 sealed thereto, is subjected to manufacturing step S70 of forming the bag widthwise side edge seals 112, 114.

Figure 6:
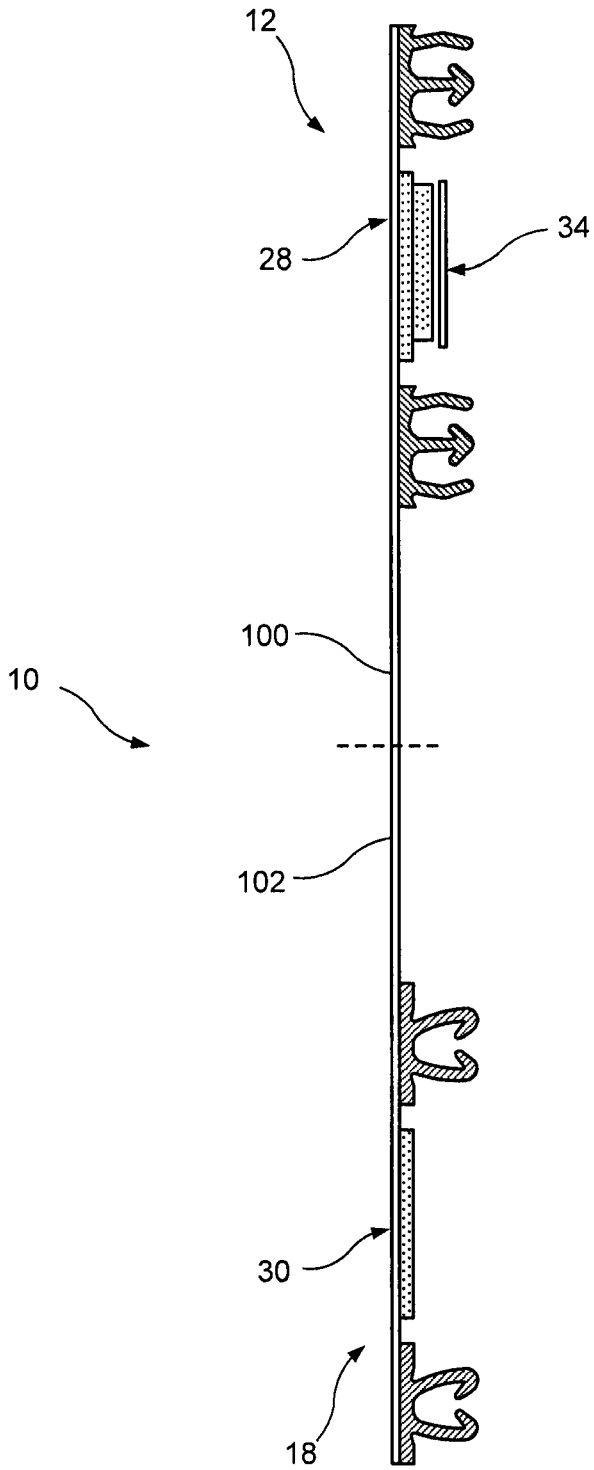
FIGS. 6-7 illustrate the security zipper as applied in the manufacturing process, as viewed along respective lines 6-6 and 7-7 in FIG. 5.
Figure 7:
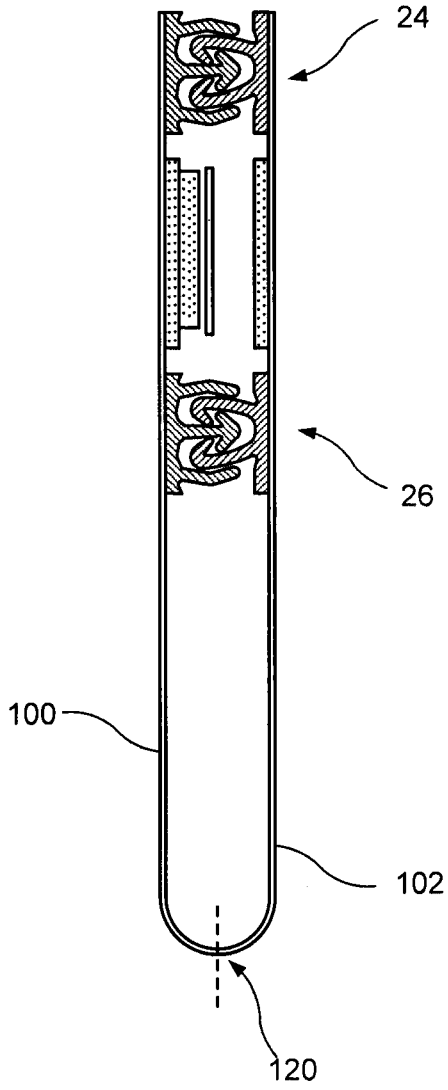

As illustrated in FIGS. 6 and 7, the long length of zipper 10 is a unitary member which includes the first profile 12 interconnected with the second profile 18 via the first and second product side flanges 100, 102. Accordingly, the step S20 of positioning the first profile against the second profile includes folding the first profile 12 over the second profile 18 to form a U-shape as illustrated in FIG. 7. This forms the pairs of interlocking elements 24, 26. The folding can be obtained by the use of various folding or zipper guiding mechanisms. Alternatively, the zipper halves could be fed separately. In addition, the zipper guides can hold the zipper elements in alignment during subsequent processing.

In the connected first and second profiles 12, 18, the product side flanges 100, 102 can be connected along a perforated line 120 illustrated in FIG. 7. The perforations can be broken at some point during the manufacturing process or the perforations can be left intact for the bag user to break open. Alternatively, the connected first and second product side flanges 100, 102 are provided without perforations and are slit in a bag widthwise direction, in the same location as identified for the perforated line 120, so as to separate the first and second profiles 12, 18.

The manufacturing step S30 of modifying the length of the release liner 34 can include removing the release liner 34 from the adhesive and cutting-out or punching-out the release liner 34 or cutting the release liner 34 into segments which are smaller than a widthwise distance between the bag edge seals 112, 114. The step S30 further includes thereafter reapplying the release liner.

Yet alternatively, the step of modifying the length of the release liner 34 can include removing the release liner 34 from the adhesive, cutting the release liner 34 into segments which are long enough in a bag widthwise direction to include the pull tab 36, and reapplying the release liner 34. During reapplication, the liner 34 can be configured so that the pull tab 36 is folded at an angle that projects the tab 36 above the consumer side of the zipper 10 in a bag height-wise direction.

The step S40 of creating the first slider endstop 84 includes crushing the consumer side pair of interlocking elements 24 at the first widthwise end 86 of the zipper. This is the area where the first bag side seal 112 will subsequently be located.

The manufacturing step S60 of sealing the bag web 118 to the product side flanges 100, 102 of the respective profiles 12, 18 includes, for example, heat sealing, ultrasonic sealing, and/or applying adhesives.

In addition, the step S70 of forming the bag side seals 112, 114 includes, for example, cutting the bag web 118 with a hot knife for fusing leading and trailing edges of the bag web, that is, at the locations of the side seals 112, 114. Alternatively, discrete side seals can be made on each side of the bag and the bag can be severed from the continuous web 118 and continuous zipper 10 by a separate cutting process. Yet alternatively, this step could include providing a wide seal (not illustrated) in the bag web 118 and cutting through a middle of the wide seal.

The following is a summary of the individual steps of the disclosed manufacturing process which provide advantages over known manufacturing processes: feeding a unitary, unmated zipper assembly (provided with a security feature) into a bag making process; folding the zipper so it is in a mating position, or slitting a unitary zipper and folding, or feeding separate profiles in separate strips and orienting the profiles into a mating position; mating only certain portions of the zippers, in the area of the bag side seals; removing the release liner from the adhesive and punching out or cutting the release liner or otherwise removing a portion of the liner so it does not extend into the bag side seals, and reapplying the liner; and folding the release liner so that it extends above the top of the zipper in a bag height-wise direction.

In sum, what has been disclosed is a security zipper, a security bag, and method of manufacturing the bag, which becomes noticeably damaged if there is an attempt to reopen, such that pilferage of the contents is relatively difficult as compared with prior art security bags.

Thus the several aforementioned objects and advantages are most effectively attained. Although preferred embodiments of the invention have been disclosed and described in detail herein, it should be understood that this invention is in no sense limited thereby and its scope is to be determined by that of the appended claims.

We claim:

1. A security zipper comprising:

a first profile including a first consumer side interlocking element and a first product side interlocking element spaced therefrom by a first intermediate flange;

a second profile including a second consumer side interlocking element and a second product side interlocking element spaced therefrom by a second intermediate flange;

the first and second consumer side interlocking elements define a pair of consumer side interlocking elements and the first and second product side interlocking elements define a pair of product side interlocking elements, both pairs of interlocking elements being capable of secure mating; and the first and second intermediate flanges define a pair of intermediate flanges which are capable of secure connecting;

whereby the zipper profiles are substantially permanently secured to each other to a degree that subsequent separation of the first profile from the second profile would cause noticeable damage to the security zipper;

wherein one or both of the first consumer side interlocking element and the first product side interlocking element is a male zipper element, and a corresponding one or both of the second consumer side interlocking element and the second product side interlocking element is a female zipper element; and wherein, for each male and female zipper element pair:

the male zipper element includes a base, a consumer side exterior rib, a central rib, and a product side exterior rib, the central rib including a distal end wedge that has a consumer side hook and a product side hook;

the female zipper element includes a base, a consumer side leg having a distal end foot and a product side leg having a distal end foot;

the male zipper element and the female zipper element are substantially symmetric about respective centerlines extending parallel to a bag thickness direction;

when the zipper elements are mated and not pivoted relative to each other:

the legs fit between respective exterior ribs and are spaced from each other by the central rib, and the exterior ribs are spaced from respective legs;

the consumer side foot contacts the consumer side of the central rib and the product side foot contacts the product side of the central rib; and the consumer side hook contacts the consumer side leg and the product side hook contacts the product side leg.

2. The security zipper of claim 1, wherein the first intermediate flange comprises a pressure sensitive adhesive having a high bond strength and a high cohesive strength.

3. The security zipper of claim 2, wherein the second intermediate flange comprises an adhesive enhancer.

4. The security zipper of claim 3, wherein the adhesion enhancer comprises a modified ethylene vinyl acetate or a modified polyolefin.

5. The security zipper of claim 3, further comprising a slider, surrounding the pair of consumer side interlocking elements, the pair of intermediate flanges, and the pair of product side interlocking elements, so that sliding the slider in bag widthwise direction across the security zipper securely mates the consumer side interlocking elements and the product side locking elements, and securely connects the first intermediate flange with the second intermediate flange, securely closing the zipper.

6. The security zipper of claim 5, wherein the slider includes a first pressure bar for biasing the first intermediate flange towards the second intermediate flange, and a second pressure bar for biasing the second intermediate flange towards the first intermediate flange, thereby engaging the pressure sensitive adhesive and the adhesion enhancer.

7. The security zipper of claim 6, wherein:

the slider has a first inner wall which is essentially parallel with the first intermediate flange and a second inner wall which is essentially parallel with the second intermediate flange; and the first pressure bar is cantilevered to the first inner wall and the second pressure bar is cantilevered to the second inner wall.

8. The security zipper of claim 5, comprising a first endstop disposed at a first end of the security zipper in a widthwise direction for preventing the slider from sliding off of the security zipper at the first end of the zipper before the zipper is securely closed by the slider.

9. The security zipper of claim 8, wherein the first endstop is comprised of a compressed portion of the consumer side zipper pair at the first end of the zipper.

10. The security zipper of claim 8, wherein the slider includes a consumer side end for engaging the first endstop.

11. The security zipper of claim 2, comprising a release liner covering the pressure sensitive adhesive.

12. The security zipper of claim 11, wherein the release liner includes a tab for removing the release liner from the pressure sensitive adhesive.

13. The security zipper of claim 12, wherein the tab extends past the pair of consumer side interlocking elements of the zipper for engagement by a user.

14. The security zipper of claim 11, where the release liner includes cut-out sections.

15. The security zipper of claim 14, where the release liner cut-out sections are disposed at respective bag seals.

16. The security zipper of claim 1, wherein within each pair of zipper elements:

the hooks are oriented toward the male zipper base and the feet are oriented toward the female zipper base;

the exterior ribs extend away from the male zipper base and away from each other until reaching respective length-wise midpoints, increasing a distance between the exterior ribs in a bag height-wise direction; and from the midpoints, the exterior ribs extend further away from the male zipper base and toward each other until reaching respective distal ends of the exterior ribs, decreasing a distance between the exterior ribs in a bag height-wise direction; and the legs extend away from the female zipper base and away from each other until reaching respective distal ends of the legs, thereby increasing a distance between the legs in a bag height-wise direction.

17. The security zipper of claim 1, wherein within each mated pair of zipper elements:

when the zipper elements are not pivoted relative to each other and are translated away from each other in the bag thickness direction, the consumer side hook engages the consumer side foot; and the product side hook engages the product side foot;

when the female zipper base is pivoted towards the product side relative to the male zipper element, the product side foot engages the product side of the central rib; a distal end of the product side rib engages a product side joint located between the product side leg and the female zipper base; a distal end of the consumer side leg engages the consumer side rib; and the consumer side foot engages both the consumer side of the central rib and the consumer side hook; and when the female zipper base is pivoted towards the consumer side relative to the male zipper element, the consumer side foot engages the consumer side of the central rib; a distal end of the consumer side rib engages a consumer side joint located between the consumer side leg and the female zipper base; and a distal end of the product side leg engages the product side rib; and the product side foot engages both the product side of the central rib and the product side hook;

whereby the connected zipper pair is substantially permanently securely mated.

* * * * *